US008042522B2

(12) United States Patent
Achor et al.

(10) Patent No.: US 8,042,522 B2
(45) Date of Patent: Oct. 25, 2011

(54) FUEL RAIL VENT SYSTEM

(75) Inventors: Kyle Achor, Monticello, IN (US); Michael Richards, Kokomo, IN (US); Richard Harvey, Logansport, IN (US)

(73) Assignee: Federal Mogul Corporation, Southfield, MI (US)

( * ) Notice: Subject to any disclaimer, the term of this patent is extended or adjusted under 35 U.S.C. 154(b) by 340 days.

(21) Appl. No.: 12/478,980

(22) Filed: Jun. 5, 2009

(65) Prior Publication Data

US 2010/0101535 A1 Apr. 29, 2010

Related U.S. Application Data

(60) Provisional application No. 61/108,275, filed on Oct. 24, 2008.

(51) Int. Cl.
*F02M 37/20* (2006.01)
*F02M 37/22* (2006.01)

(52) U.S. Cl. ..... 123/516; 123/456

(58) Field of Classification Search ..... 123/516, 123/518, 519, 520, 456, 514, 461, 179.9, 123/179.24, 198 D; 137/256, 265, 587, 588; 440/88 A See application file for complete search history.

(56) References Cited

U.S. PATENT DOCUMENTS

| | | | | |
|---|---|---|---|---|
| 4,809,666 | A * | 3/1989 | Baltz | 123/516 |
| 5,389,245 | A | 2/1995 | Jaeger et al. | |
| 5,890,472 | A | 4/1999 | Saito | |
| 5,913,294 | A * | 6/1999 | Takahashi et al. | 123/198 DB |
| 6,058,912 | A | 5/2000 | Rembold et al. | |
| 6,067,966 | A | 5/2000 | Saito et al. | |
| 6,257,208 | B1 * | 7/2001 | Harvey | 123/516 |
| 6,302,086 | B1 | 10/2001 | Kato | |
| 6,318,344 | B1 | 11/2001 | Lucier et al. | |
| 6,408,835 | B1 | 6/2002 | Katayama et al. | |
| 6,453,877 | B1 | 9/2002 | Lucier et al. | |
| 6,502,559 | B2 | 1/2003 | Katayama et al. | |
| 6,553,974 | B1 | 4/2003 | Wickman | |
| 6,694,955 | B1 | 2/2004 | Griffiths et al. | |
| 6,701,900 | B1 | 3/2004 | Millar et al. | |
| 6,718,953 | B1 | 4/2004 | Torgerud | |
| 6,889,656 | B1 | 5/2005 | Rembold | |
| 7,216,614 | B2 | 5/2007 | Shibata et al. | |
| 7,350,510 | B2 | 4/2008 | Tomatsuri et al. | |

FOREIGN PATENT DOCUMENTS

| | | |
|---|---|---|
| DE | 44 10 367 A1 | 9/1995 |
| DE | 101 27 516 A1 | 12/2002 |
| WO | WO 2005-119048 | 12/2005 |

* cited by examiner

*Primary Examiner* — Mahmoud Gimie

(74) *Attorney, Agent, or Firm* — Robert L. Stearns; Dickinson Wright PLLC

(57) ABSTRACT

A fuel rail vent system for evacuating air from a fuel rail includes a first fuel reservoir and a first fuel line extending between the first fuel reservoir and the fuel rail. A fuel pump is configured in fluid communication with the first fuel reservoir to pump liquid fuel from the first fuel reservoir to the fuel rail through the first fuel line. A second fuel line separate from the first fuel line extends between the first fuel reservoir and the fuel rail. A primer system is configured for fluid communication with the first fuel reservoir to pump liquid fuel from the first fuel reservoir to the fuel rail through the second fuel line. A second fuel reservoir separate from the first fuel reservoir is configured for fluid communication with the fuel rail downstream of the fuel rail to receive any excess liquid fuel and/or fuel vapor upstream therefrom.

10 Claims, 2 Drawing Sheets

FUEL RAIL VENT SYSTEM

CROSS-REFERENCE TO RELATED APPLICATION

This application claims the benefit of U.S. Provisional Application Ser. No. 61/108,275, filed Oct. 24, 2008, which is incorporated herein by reference in its entirety.

BACKGROUND OF THE INVENTION

1. Technical Field

This invention relates generally to fuel injected internal combustion engines, and more particularly to vent systems for fuel rails of fuel injected engines.

2. Related Art

Fuel injected internal combustion engines require liquid fuel to be injected through fuel injectors for the engine to be started, as well as during operation. It is particularly important that liquid fuel, and not air, be present in the fuel rail and in the injectors during a starting procedure. This becomes even more important for engines having pull start mechanisms, such as those used in marine applications, for example. If a user pulls a start cord while air is present in the fuel rail, the likelihood that the engine will start is greatly reduced. This can lead to a frustrated user, as well as making it even more difficult to start the engine. Accordingly, ensuring liquid fuel is present in the fuel rail prior to pulling on the start cord is critical in order to optimize the potential for the engine to start.

SUMMARY OF THE INVENTION

A fuel rail vent system includes a fuel rail having a plurality of fuel injectors with a first fuel reservoir and a first fuel line extending between the first fuel reservoir and the fuel rail. Further, a high pressure fuel pump is configured for fluid communication with the first fuel reservoir to pump liquid fuel under pressure from the first fuel reservoir to the fuel rail through the first fuel line. In addition, the system includes a second fuel line separate from the first fuel line. The second fuel line extends between the first fuel reservoir and the fuel rail. The system further includes a primer pump configured for fluid communication with the first fuel reservoir to pump liquid fuel under pressure from the first fuel reservoir to the fuel rail through the second fuel line. Further, the system includes a second fuel reservoir separate from the first fuel reservoir. The second fuel reservoir is configured for fluid communication with the fuel rail downstream of the fuel rail to receive any excess liquid fuel and/or fuel vapor upstream therefrom.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
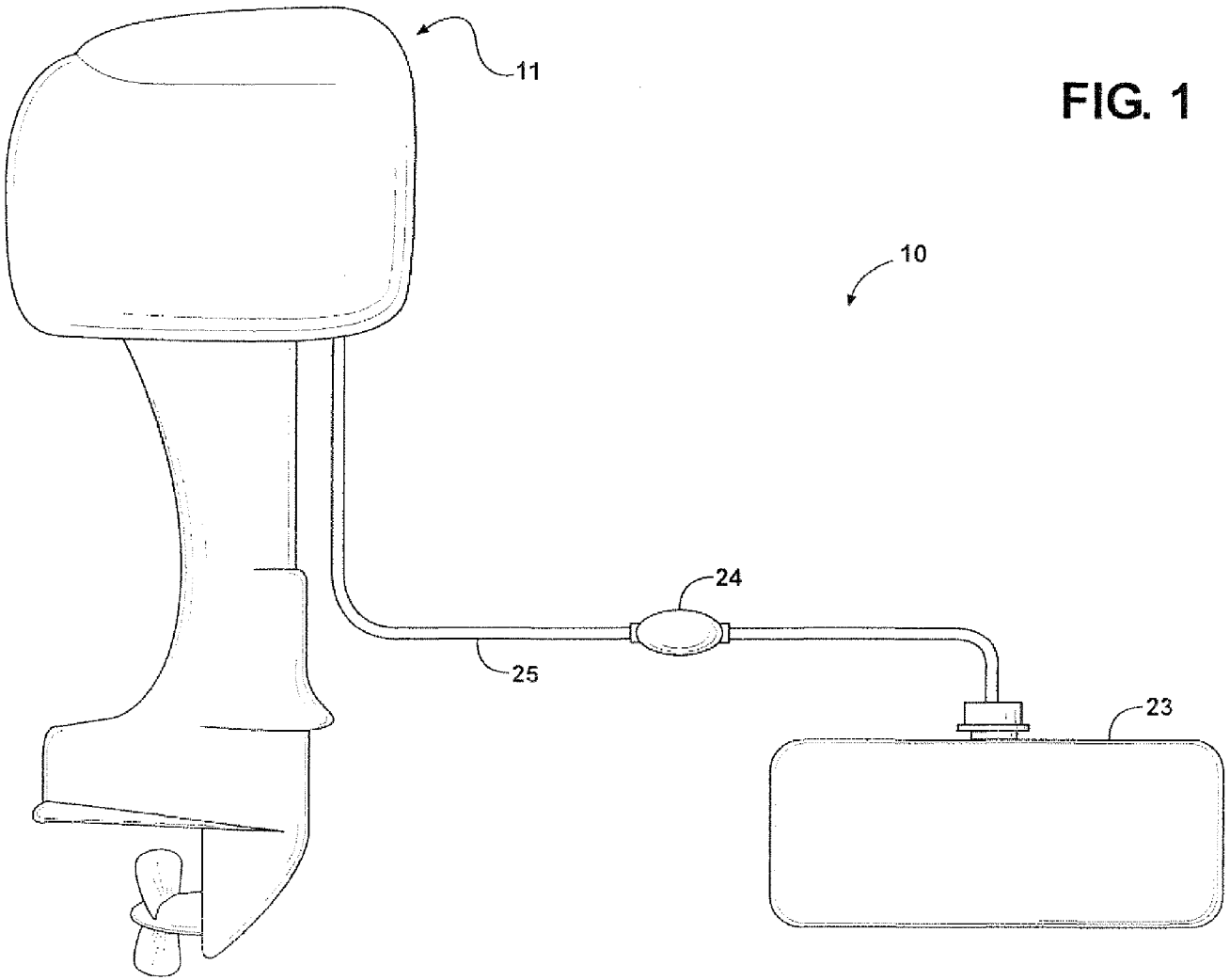
FIG. 1 is a schematic view of an outboard marine engine having a fuel rail vent system constructed according to one presently preferred aspect of the invention.
Figure 2:
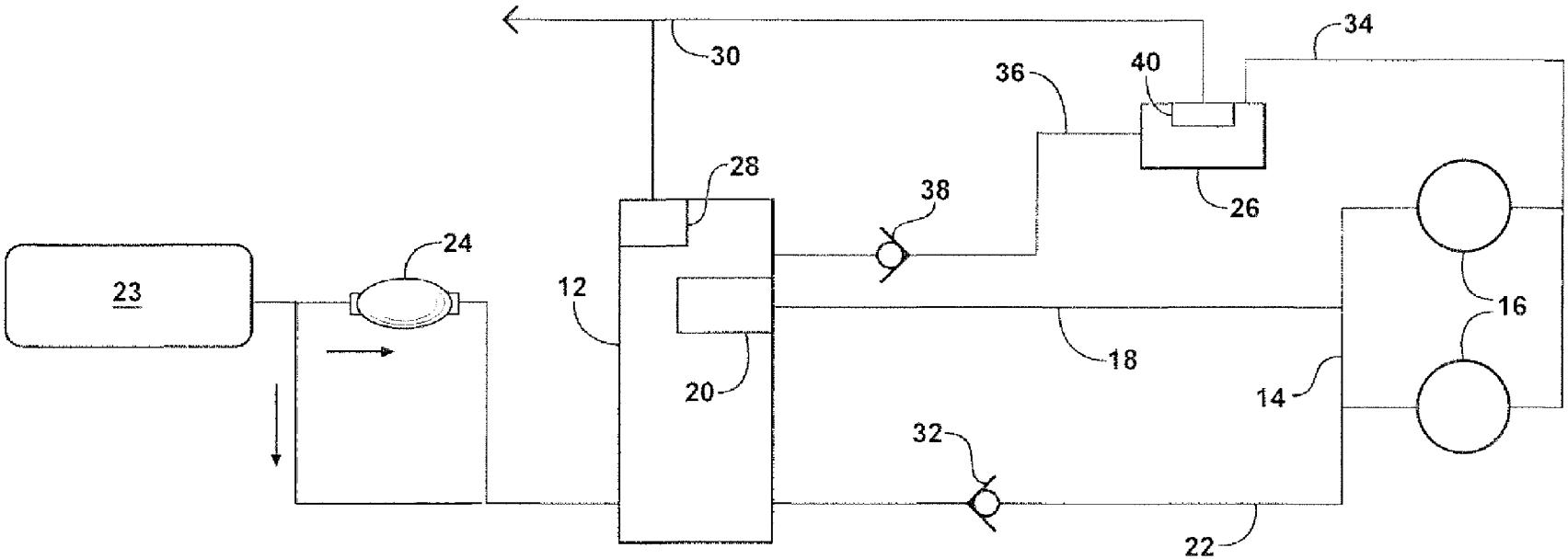
FIG. 2 is a schematic diagram of the fuel system of FIG. 1.

Referring in more detail to the drawings, FIG. 1 illustrates an outboard marine engine 11 having a fuel rail vent system constructed in accordance with one presently preferred embodiment of the invention indicated generally at 10. The fuel vent system 10 includes a first fuel reservoir 12; a fuel rail 14 having one or more fuel injectors 16 in fluid communication with the reservoir 12 via a first fuel flow path, and represented here, by way of example and without limitation, as being in fluid communication via a first fuel line 18 extending between the first fuel reservoir 12 and the fuel rail 14. The system 10 further has a high pressure fuel pump 20 configured for fluid communication with the first fuel reservoir 12, and represented here, by way of example and without limitation, as being received in the first fuel reservoir 12, to pump fuel under high pressure from the first fuel reservoir 12 to the fuel rail 14 through the first fuel line 18. The system 10 further includes a second fuel flow path, represented here, by way of example and without limitation, as a second fuel line 22 separate from the first fuel line 18. The second fuel line 22 extends between the first fuel reservoir 12 and the fuel rail 14. The system 10 includes a primer system 24, which can include a gravitationally actuated system, wherein a source of liquid fuel 23 can be located above the first fuel reservoir 12 such that gravity will cause fuel from the fuel force 23 to flow through a fuel supply line 25 and ultimately to the fuel rail 14. In addition to or in place of a gravitational fuel feed, the primer system 24 can include an electrically or mechanically actuated pump 24 upstream of the first fuel reservoir 12. The pump 24 is illustrated, by way of example and without limitation, as a resilient, compressible bulb that is configured for fluid communication via the fuel line 25 with the first fuel reservoir 12 to pump fuel under pressure from the first fuel reservoir 12 to the fuel rail 14 through the second fuel line 22. Further yet, the system 10 includes a second fuel reservoir 26 separate from the first fuel reservoir 12. The second fuel reservoir 26 is configured for fluid communication with the fuel rail 14 downstream of the fuel rail 14. The second fuel reservoir 26 is operable to receive air and/or fuel from the fuel rail 14 upon pumping liquid fuel from the first fuel reservoir 12 via the primer pump 14. As such, any air within the fuel rail 14 is able to be readily purged from the fuel rail 14 to ensure that the fuel injectors 16 receive liquid fuel. Accordingly, starting the engine is made reliable, particularly wherein the engine has a pull-type starting mechanism, such as those commonly used in marine engine applications, for example.

The first fuel reservoir 12 is represented as having the high pressure fuel pump 20 received therein, as known, though an externally mounted fuel pump is also contemplated herein. The fuel pump 20 is configured to pump liquid fuel under high pressure from within the first fuel reservoir 12 through the first fuel line 18 directly to the fuel rail 14. Upon being received in the fuel rail 14, the liquid fuel is distributed to the fuel injectors 16. The first fuel reservoir 12 also has a vapor vent valve, represented here, by way of example and without limitation, as being a float actuated vapor vent valve 28. The vent valve 28 is operable to vent vapor from within the first fuel reservoir to a vapor vent line 30. The vapor vent line 30 is preferably directed to an air intake manifold (not shown) of the engine.

The second fuel line 22 channels liquid fuel from within the first fuel reservoir 12 to the fuel rail 14. To prevent fuel from flowing in the reverse direction from the fuel rail 14 back to the first fuel reservoir 12, a one-way check valve 32 is disposed in the second fuel line 22 between the fuel rail 14 and the first fuel reservoir 12.

The second fuel reservoir 26 is configured for fluid communication with the fuel rail 14 via an injector return line 34. As such, any fuel and/or air directed downstream from the fuel rail 14, such as while actuating the primer pump 24, is able to flow from the fuel rail 14 to the second fuel reservoir 26. The second fuel reservoir 26 is configured in fluid communication with the first fuel reservoir 12 via a fuel return line 36. As such, any excess liquid fuel within the second fuel reservoir 26 is able to flow under pressure back to the first fuel reservoir 12. To prevent fuel from flowing in the reverse direction, from the first fuel reservoir 12 to the second fuel reservoir 26, a one-way valve, such a fuel pressure regulator 38, is disposed in the fuel return line 36. In addition, the second fuel reservoir 26 has a vapor vent valve, represented here, by way of example and without limitation, as being a float actuated vapor vent valve 40. The vent valve 40 is operable to vent vapor from within the second fuel reservoir to the vapor vent line 30.

In use, the fuel rail vent system 10 provides a method for evacuating air from the fuel rail 14 prior to initiating a starting procedure for the engine. To implement the method, an actuating step is performed by actuating the primer pump 24, such as by depressing a resilient bulb a predetermined number of times, for example. By actuating the primer pump 24, a predetermined volume of priming liquid fuel is pumped through the fuel supply line 25 into the first fuel reservoir 12 and from the first fuel reservoir 12 through the second fuel line 22 to the fuel rail 14. The priming liquid fuel flowing through the fuel rail 14 causes any air within the fuel rail 14 to be directed through the injector return line 34 to the second fuel reservoir 26. As such, as a starting step is initiated to start the engine, such as by pulling the starter cord, the fuel injectors 16 are assured of spraying liquid fuel substantially free from vapor. The air and liquid fuel reaching the second fuel reservoir 26 are separated, wherein the liquid fuel with the second fuel reservoir 26 is directed back to the first fuel reservoir 12 via the fuel return line 36, while the vapor is directed through the vent valve 40 and to the air intake manifold of the engine via the vapor line 30.

Obviously, many modifications and variations of the present invention are possible in light of the above teachings. It is, therefore, to be understood that within the scope of the appended claims, the invention may be practiced otherwise than as specifically described.

What is claimed is:

1. A fuel rail vent system, comprising:

a first fuel reservoir;

a fuel rail having a fuel injector;

a first fuel flow path providing fluid communication between said first fuel reservoir and said fuel rail;

a high pressure fuel pump configured for fluid communication with said first fuel reservoir to pump fuel under pressure from said first fuel reservoir to said fuel rail through said first fuel line;

a second fuel flow path separate from said first fuel flow path, said second fuel flow path providing fluid communicating between said first fuel reservoir and said fuel rail;

a primer system configured for fluid communication with said first fuel reservoir to pump fuel from said first fuel reservoir to said fuel rail through said second fuel flow path; and a second fuel reservoir separate from said first fuel reservoir, said second fuel reservoir being configured for fluid communication with said fuel rail downstream of said fuel rail.

2. The fuel rail vent system of claim 1 further comprising a return fuel flow path extending between said second fuel reservoir and said first fuel reservoir for directing fuel flow from said second fuel reservoir to said first fuel reservoir.

3. The fuel rail vent system of claim 2 further comprising a one-way valve in said return fuel flow path allowing flow toward said first fuel reservoir and preventing reverse flow from said first fuel reservoir toward said second fuel reservoir.

4. The fuel rail vent system of claim 2 further comprising a vapor vent line configured for communication with said first and second fuel reservoirs to direct fuel vapor from said first and second fuel reservoirs to an air intake of an engine.

5. The fuel rail vent system of claim 4 further comprising a first vapor vent valve configured to vent vapor from said first fuel reservoir to said vapor vent line and a second vapor vent valve configured to vent vapor from said second fuel reservoir to said vapor vent line.

6. The fuel rail vent system of claim 1 further comprising a one-way valve in said second fuel flow path, said one-way valve allowing fuel to flow from said first fuel reservoir to said fuel rail and preventing fuel from flowing from said fuel rail toward said first fuel reservoir.

7. The fuel rail vent system of claim 1 wherein said primer system is located upstream of said first fuel reservoir.

8. The fuel rail vent system of claim 7 wherein said primer system is a mechanically actuated pump.

9. The fuel rail vent system of claim 8 wherein said pump includes a resilient, compressible bulb.

10. The fuel rail vent system of claim 7 wherein said primer system is gravitationally actuated.

* * * * *